US011596220B1

(12) United States Patent
Clark

(10) Patent No.: US 11,596,220 B1
(45) Date of Patent: Mar. 7, 2023

(54) CARRYING DEVICE

(71) Applicant: Kevin Clark, Riverview, FL (US)

(72) Inventor: Kevin Clark, Riverview, FL (US)

( * ) Notice: Subject to any disclaimer, the term of this patent is extended or adjusted under 35 U.S.C. 154(b) by 294 days.

(21) Appl. No.: 16/920,094

(22) Filed: Jul. 2, 2020

(51) Int. Cl.
*A45F 5/10* (2006.01)

(52) U.S. Cl.
CPC .... *A45F 5/1046* (2013.01); *A45F 2005/1066* (2013.01)

(58) Field of Classification Search
CPC ..... A45F 5/1046; A45F 2005/1066
See application file for complete search history.

(56) References Cited

U.S. PATENT DOCUMENTS 2,274,605 A * 2/1942 Hoffmeister ..... A45C 13/26 294/171
4,262,385 A * 4/1981 Norman ..... A45F 5/10 294/149
5,083,825 A * 1/1992 Bystrom ..... A45F 5/1046 294/171
5,364,148 A * 11/1994 Bartocci ..... A45F 5/1046 D9/434
D362,181 S * 9/1995 Meyers ..... D9/434
D369,549 S * 5/1996 Meyers ..... D9/434
6,378,925 B1 * 4/2002 Greenlee ..... A45F 5/1046 294/171
6,901,635 B1 * 6/2005 Scola ..... A45F 5/1026 294/171
7,387,324 B1 * 6/2008 Sharpe ..... A45F 5/1026 294/171
7,625,029 B2 12/2009 Jenkins
8,695,168 B1 * 4/2014 Cepeda ..... B25G 1/10 16/431
9,326,588 B2 * 5/2016 Jones ..... A45F 5/10
9,545,142 B2 * 1/2017 Pitchforth ..... A45C 13/26
10,285,491 B2 5/2019 Xing
D867,492 S * 11/2019 Didia ..... D21/694
11,350,727 B1 * 6/2022 Schantz ..... A45F 5/1046
2003/0131447 A1 * 7/2003 Mikus ..... A45F 5/1046 16/422
2004/0117947 A1 * 6/2004 Greenlee ..... A45F 5/1046 16/110.1
2006/0163894 A1 * 7/2006 Mishek ..... A45F 5/1046 294/171
2008/0193056 A1 * 8/2008 Ceranic ..... A45F 5/1046 383/7
2014/0197215 A1 * 7/2014 Thiessen ..... A45C 13/001 224/264

(Continued)

*Primary Examiner* — Victor D Batson
*Assistant Examiner* — Matthew J Sullivan
(74) *Attorney, Agent, or Firm* — Sanchelima & Associates, P.A.; Christian Sanchelima; Jesus Sanchelima

(57) ABSTRACT

A system for a carrying device to carry and transport bags including a carrier assembly and a closure assembly. The carrier assembly includes a carrier body that is U-shaped and grasped within the palm of a user. The carrier body includes a foam outer portion to provide comfort to the user during usage. The carrier body also includes a rigid inner portion which is where bag handles are secured thereto. The bags remain secured within a cavity defined by the inner portion. To ensure that the bags remain secured within the carrier body a closure of the closure assembly is secured to the carrier body. The closure selectively opens to allow access to the cavity to secure or remove bags from carrier body.

7 Claims, 2 Drawing Sheets

(56) References Cited

U.S. PATENT DOCUMENTS

| | | | | |
|---|---|---|---|---|
| 2014/0292011 | A1* | 10/2014 | Liszkiewicz | A45F 5/1046<br>294/171 |
| 2014/0302287 | A1* | 10/2014 | Lehtonen | A45C 13/001<br>428/192 |
| 2015/0257518 | A1* | 9/2015 | Burkman | A45F 5/1046<br>294/171 |
| 2018/0035795 | A1* | 2/2018 | Cloutier | A45F 5/1046 |

* cited by examiner

CARRYING DEVICE

BACKGROUND OF THE INVENTION

1. Field of the Invention

The present invention relates to a carrying device and, more particularly, to a carrying device that facilitates the carrying of multiple bags at once.

2. Description of the Related Art

Several designs for bag carrying devices have been designed in the past. None of them, however, include a bag carrying device comprising a foam U-shaped body with a hinged closure that is fastened with Velcro on one side of the u-shaped body. It may be possible to carry and transport multiple bags with the U-shaped body of the present invention. The carrying device allows users to be more efficient as they can carry more bags at one time, such as grocery bags, thereby saving time.

Applicant believes that a related reference corresponds to U.S. Pat. No. 10,285,491 for a bag carrier. Applicant believes that another related reference corresponds to U.S. Pat. No. 7,625,029 for a bag gripper for plastic bag handles. None of these references, however, teach of a bag carrying device with a foam body having a hinged closure to secure the bags to the bag carrying device.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a carrying device that allows a user to carry multiple bags at once.

It is another object of this invention to provide a carrying device that helps to provide comfort to the user's hand even while the user is carrying a heavy load of numerous bags at once.

It is still another object of the present invention to provide a carrying device that allows users to quickly and more efficiently transport multiple bags at once thereby saving time on mundane tasks.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
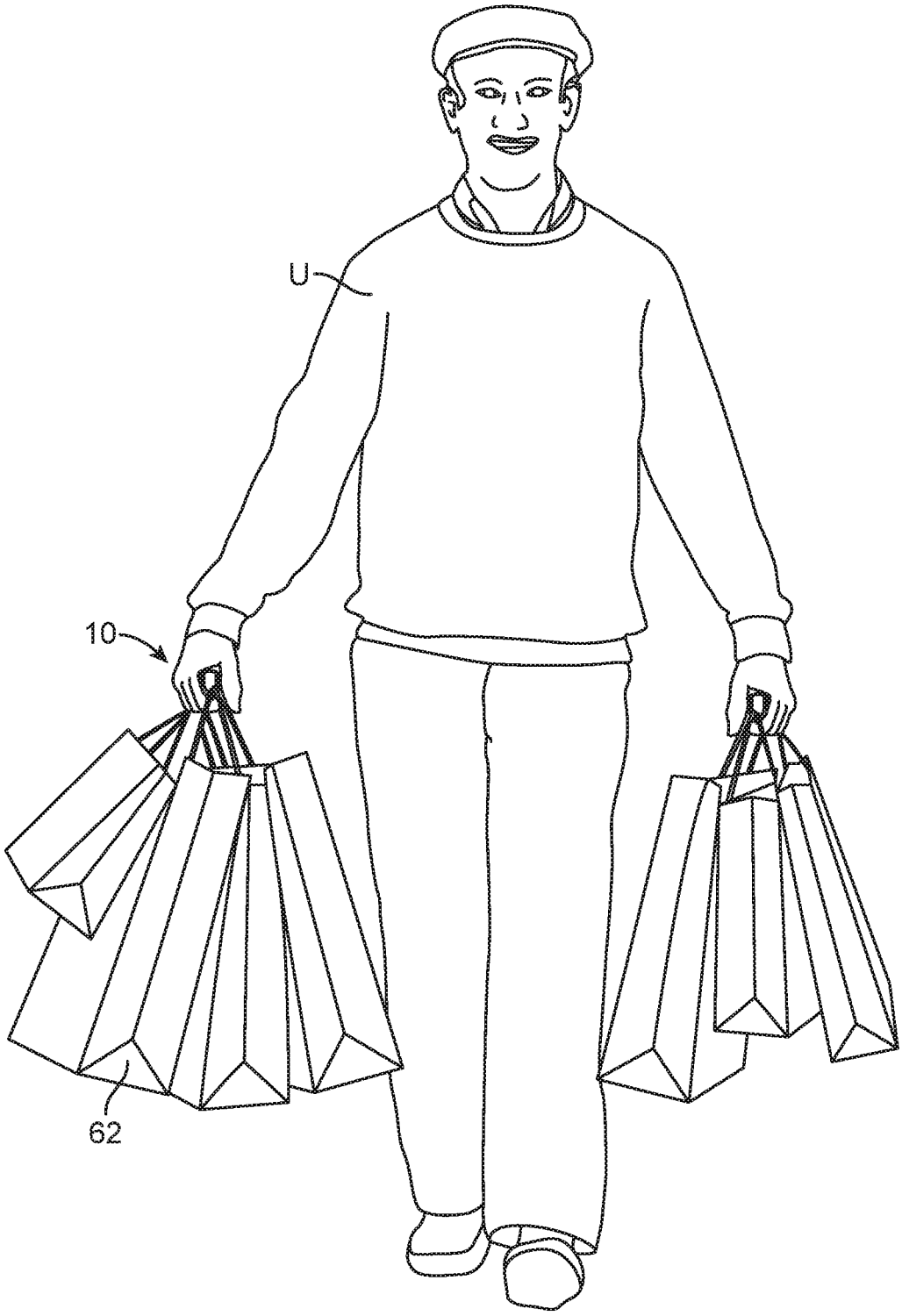
FIG. 1 represents an operational view of the carrying device 10.

Referring now to the drawings, where the present invention is generally referred to with numeral 10, it can be observed that it basically includes a carrier assembly 20 and a closure assembly 40.

A carrying device 10 may assist a user U to carry multiple bags 62 at once. Thereby resulting in user U being more efficient with their time as less trips are needed to transport the needed bags 62. Carrying device 10 allows for more of bags 62 to be carried and transported in less trips. Carrying of bags 62 may also be harsh on the hands and palms of user U as a large load such as multiple of bags 62 are carried. Carrying multiple bags 62 at once often results in the hands of user U being cut as the handle of the carried bags 62 digs into the hands and palms of user U. As such carrying device 10 may also provide comfort to user U to maintain their hands and skin healthy.

Carrying device 10 may include carrier assembly 20. Carrier assembly 20 may assist and facilitate carrying of bags 62. Carrier assembly 20 may include a carrier body 22. Carrier body 22 may importantly have a U-shaped configuration. It is to be understood that bags 62 may be carried atop of carrier body 22. While user U may grip and carry carrier body 22 from an underside thereof. It may be suitable for carrier body 22 to be made of a combination of rigid and flexible materials. It may be suitable for carrier body 22 to be received in the palm of user U during usage.

Figure 2:
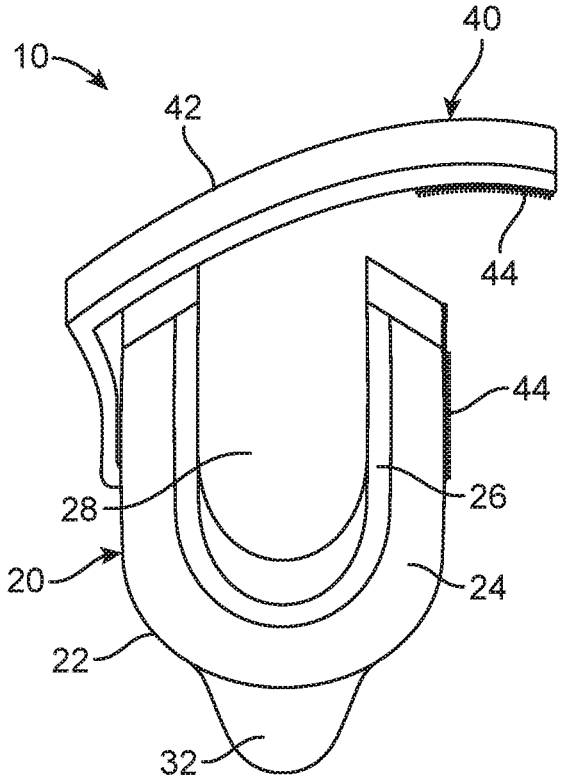
FIG. 2 shows an isometric side view of the carrying device 10.

As best seen in FIG. 2, carrier body 22 may include an outer portion 24 and an inner portion 26. Each of outer portion 24 and inner portion 26 may include the same U-shaped configuration that carrier body 22 does. It may be suitable for outer portion 24 to be beneath of inner portion 26. Outer portion 24 may be of greater dimensions than those of inner portion 26. It is to be understood that outer portion 24 may be in constant abutting contact with inner portion 26. Outer portion 24 may be made of a flexible material such as foam, in one embodiment. It may be possible for outer portion 24 to be resilient to allow compressing and expanding thereof. Inner portion 26 may be made of a rigid material 26 such as plastic, wood, metal, aluminum or the like. Bags 62 may be secured atop of inner portion 26 within a cavity 28 defined within carrier body 22 and more specifically inner portion 26. More specifically that handle of bags 62 are secured within the cavity 28 and atop of inner portion 26. With bags 62 secured on inner portion 26, user U may grip and carrying the carrier body 22 by grasping outer portion 24 from underneath. It is to be understand that preferably, outer portion 24 may be entirely received within the palm of user U. As outer portion 24 may be in constant abutting contact with the palm of user U it may be necessary for outer portion 24 to be flexible and comfortable. Outer portion 24 may compress as bags 62 secured within carrier body 22 become heavier. Additionally, outer portion 24 may compress as user U tightens their grip on outer portion 24.

Figure 3:
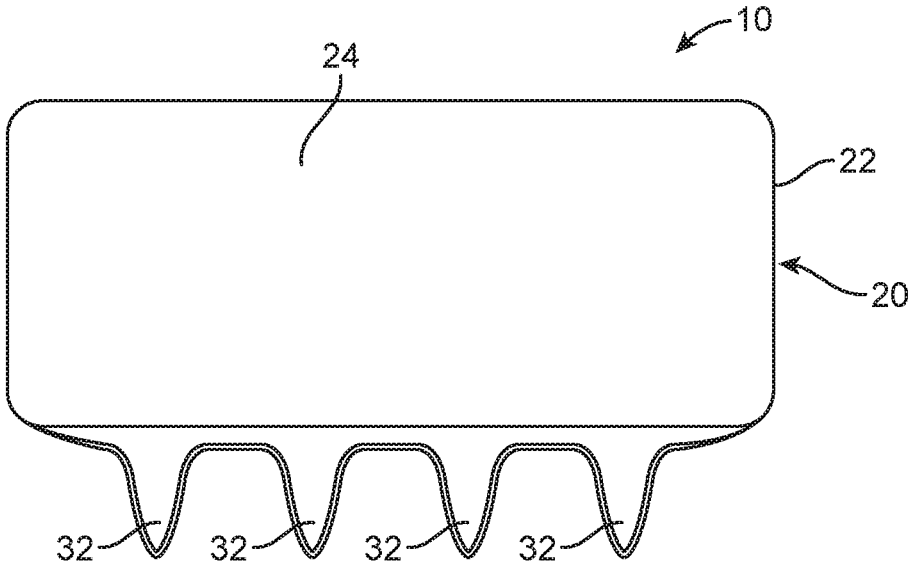
FIG. 3 illustrates a zoomed in view of the grip members 32.

For added comfort and grip, outer portion 24 may include grip members 32, as best illustrated in FIG. 3. Grip members 32 may be located on an underside of outer portion 24. Grip members 32 may extend from a rear to a front of outer portion 24 as best seen in FIG. 2. It can be seen in FIG. 2-3, that grip members 32 may extend outwardly and away from outer portion 24. Grip members 32 may be evenly spaced apart. Grip members 32 may be adapted to receive the fingers of user U in between as carrying device 10 is palmed while bags 62 are carried. Grip members 32 may provide comfort to user U to avoid injury to the hand, palm and fingers of user U as numerous of bags 62 are carried.

Closure assembly 40 may assist in securing bags 62 within carrier body 22. It can be seen that closure assembly 40 may include a closure 42. Closure 42 may prevent bags 62 from being removed from cavity 28. Closure 42 may also be referred to as a strap. It is to be understood that closure 42 may preferably be flexible. Closure 42 may be secured to carrier body 22. Closure 42 may include a closed and open configuration. In the closed configuration, closure 42 may entirely extend above of carrier body 22. Closure 42 may prevent access to cavity 28 from a top face of carrier body 22. In the open configuration, one distal end of closure may be attached to carrier body 22 while the opposite distal end is detached from carrier body 22. More precisely, one distal end of closure 42 may be secured to a rear portion of outer portion 24, while the opposite distal end of closure is detachably secured to a front portion of outer portion 24. The distal of closure at the rear portion may be fixedly secured to outer portion 24 with a fastening member, adhesives or sewing. To allow closure 42 to open and close access to cavity 28 fasteners 44 may be used. Fasteners 44 may preferably be hook and loop straps. However, buttons, snap buttons, adhesives, clips, or other means may be suitable. It is to be understood that one of fasteners 44 may be mounted at the detachable distal end of closure. Another of fasteners 44 may be located at the front portion of outer portion 24 to cooperate with the one of fasteners 44 on closure 42.

Carrying device 10 allows carrying of multiple bags 62 at once, allowing user U to be more efficient when transporting bags 62. Additionally, carrying device 10 may allow user U to comfortably grip, carry and transport multiple bags 62 due to outer portion 24 which is preferably made of foam and grasped from underneath. To ensure that bags 62 remain secured within carrier body 22, closure 42 may selectively close access to cavity 28 wherein bag handles are secured. Carrying device 10 helps user U to avoid hurting their hands or palms when carrying a heavy load that is multiple of bags 62.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a carrying device, comprising:

a) a carrier assembly including a carrier body having a cavity, wherein said carrier body includes an outer portion and an inner portion, said carrier body having an U-shaped cross section with parallel extending sides, wherein each side has an angled top distal end, said carrier body has a rectangular-shaped longitudinal section with curved edges, said carrier body further includes grip members that extend outwardly from a bottommost surface of the carrier body, each grip member having a tapered terminus, said grip members being evenly spaced apart and parallel to each other; and b) a closure assembly including a closure, said closure having a first distal and a second distal end, said first distal end is hingedly attached to a rear external surface of the carrier body, the closures extends therefrom said first distal end upwardly past said angled top distal ends, said closure selectively sealing said cavity by attaching to a front external surface of said carrier body, said closure attaching to said second side with fasteners disposed at both said second distal end and on said front external surface, said closure extending entirely above of said cavity.

2. The system of claim 1, wherein said inner portion is in constant abutting contact with said outer portion, said cavity defined between said inner portion.

3. The system of claim 1, wherein said outer portion is made of foam, said outer portion being compressible and expandable.

4. The system of claim 1, wherein said inner portion is rigid, said inner portion being in constant abutting contact with a handle of said bag.

5. The system of claim 1, wherein said fasteners are hook and loop straps.

6. The system of claim 1, wherein said closure is flexible.

7. A system for a carrying device, consisting of:

a) a carrier assembly including a carrier body having a cavity, said carrier body having an U-shaped cross section with parallel extending sides, wherein each side has an angled top distal end, said carrier body has a rectangular-shaped longitudinal section with curved edges, said carrier body further includes four grip members that extend outwardly from a bottommost surface of the carrier body, each grip member having a tapered terminus, said four grip members being evenly spaced apart and parallel to each other, said carrier body having an outer portion and an inner portion, said inner portion and said outer portion being in constant abutting contact with each other, said inner portion being above of said outer portion, said outer portion being made of foam and being flexible, said inner portion being rigid; and b) a closure assembly including a closure made of a flexible material, said closure having a first distal and a second distal end, said first distal end is hingedly attached to a rear external surface of the carrier body, the closures extends therefrom said first distal end upwardly past said angled top distal ends, said closure selectively sealing said cavity by attaching to a front external surface of said carrier body, said closure attaching to said second side with hook and loop fasteners disposed at both said second distal end and on said front external surface, said closure extending entirely above of said cavity.

* * * * *